US006935893B1

(12) United States Patent
Flowers et al.

(10) Patent No.: US 6,935,893 B1
(45) Date of Patent: Aug. 30, 2005

(54) ELECTRICAL CONNECTOR WITH TERMINAL POSITION ASSURANCE DEVICE

(75) Inventors: Robert J. Flowers, Ortonville, MI (US); Robert Pust, Rochester, MI (US); Yves LePottier, Grosse Pointe, MI (US); Vijy Koshy, Rochester, MI (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/776,126

(22) Filed: Feb. 11, 2004

(51) Int. Cl.[7] ..... H01R 13/40
(52) U.S. Cl. ..... 439/595; 439/752
(58) Field of Search ..... 439/752, 595

(56) References Cited

U.S. PATENT DOCUMENTS

| | | | | | |
|---|---|---|---|---|---|
| 4,975,082 | A | * | 12/1990 | Nagasaka et al. | 439/565 |
| 5,100,345 | A | | 3/1992 | Endo et al. | 439/595 |
| 5,151,052 | A | * | 9/1992 | McCardell | 439/598 |
| 5,183,418 | A | * | 2/1993 | Yamanashi et al. | 439/752 |
| 5,292,261 | A | * | 3/1994 | Hirano et al. | 437/752 |
| 5,522,740 | A | | 6/1996 | Plocek et al. | 439/752 |
| 5,575,683 | A | * | 11/1996 | Saito et al. | 439/595 |
| 5,575,692 | A | * | 11/1996 | Cecil et al. | 439/752 |
| 5,607,327 | A | * | 3/1997 | Tsuji et al. | 439/752 |
| 5,645,453 | A | * | 7/1997 | Yamaguchi | 439/595 |
| 5,738,542 | A | * | 4/1998 | Jakobeit et al. | 439/595 |
| 5,879,192 | A | | 3/1999 | Machida et al. | 439/598 |
| 5,989,066 | A | * | 11/1999 | Cox | 439/595 |
| 6,280,234 | B1 | * | 8/2001 | Yamamoto et al. | 439/456 |
| 6,290,521 | B1 | * | 9/2001 | Suzuki et al. | 439/189 |
| 6,786,768 | B2 | * | 9/2004 | Murakami | 439/595 |

* cited by examiner

*Primary Examiner*—Ross Gushi
*Assistant Examiner*—Larisa Tsukerma
(74) *Attorney, Agent, or Firm*—Romi N. Bose

(57) ABSTRACT

An electrical connector includes a housing having a front mating end, a rear terminating end and at least one terminal-receiving passage extending in a direction defining an insertion axis extending between the ends. The passage has a rear open end communicating with the rear terminating end of the housing. A TPA device is engageable with the housing at the front mating end thereof in a pre-load position. The TPA device includes a through passage communicating with the terminal-receiving passage in the housing. The TPA device is movable rearwardly from the pre-load position to a locking position. A terminal is insertable through the rear terminating end of the housing into the rear open end of the terminal-receiving passage along the insertion axis and into the through passage in the TPA device. The terminal moves conjointly with the TPA device from the pre-load position to the locking position. A terminal lock includes a locking surface on the housing at the terminal-receiving passage engageable with the locking shoulder on the terminal Complementary interengaging ramp surfaces are provided between the TPA device and the housing and extend at an angle to the insertion axis for moving the locking shoulder of the terminal transversely of the axis onto the locking surface on the housing as the TPA device and the terminal move conjointly from the pre-load position to the locking position angularly of the axis.

15 Claims, 18 Drawing Sheets

ELECTRICAL CONNECTOR WITH TERMINAL POSITION ASSURANCE DEVICE

FIELD OF THE INVENTION

This invention generally relates to the art of electrical connectors and, particularly, to an electrical connector which incorporates an improved terminal position assurance device that locks the terminals in the connector and moves the terminals to their fully inserted positions.

BACKGROUND OF THE INVENTION

Generally, an electrical connector includes a dielectric housing mounting at least one electrically conductive terminal therein. The terminal is electrically connected to another circuit component, such as a discrete electrical wire. Connectors often are employed in mateable pairs such that each terminal and the housing of one connector are mateable with a corresponding terminal and the housing of another connector.

The terminals of electrical connectors frequently are very small components, such as components that are stamped and/or formed from thin sheet metal material. A poor quality electrical connection may occur if one or more terminals are not properly seated in its respective housing. The improper seating of a terminal in a housing may occur if the terminal is not fully inserted into the housing during the initial assembly of the connector or if the terminal is vibrated or pulled out of its fully seated condition during use of the connector. Failures of this type are a particular concern in the automotive industry where electrical components are subjected to vibration almost continuously during normal usage and are subjected to direct force during some maintenance. To avoid these problems, the automotive industry often requires connectors to be provided with some form of a terminal position assurance (TPA) system to detect incomplete insertion of the terminals and or to move inserted terminals to their fully inserted positions. The automotive industry also requires locking means for locking the terminals in the housing, and a TPA system or device may also perform this function.

Heretofore, terminals typically have been locked in a connector housing using either a locking tang on the terminal that engages a locking surface on the connector housing or a resilient locking lance on the housing that engages a locking surface on a body of the terminal. In automotive applications, tanged terminals are not as desirable as "smooth body" terminals which engage locking lances on the housing, because the tanged terminals are prone to snagging and breakage during assembly operations.

Locking lances on a connector housing for engaging locking surfaces on smooth body terminals typically comprise resilient or flexible fingers having locking hooks at the distal ends of the fingers for engaging the locking surfaces on the terminal body. The connector housing typically is molded of plastic material, and the flexible fingers are molded in the terminal cavities of the housing and require space directly behind the flexible fingers to allow the fingers to deflect when the terminals are inserted into the cavities. This additional space results in the overall size of the connector being enlarged in applications where, to the contrary, miniaturization is highly desirable. The present invention solves these various problems in an improved terminal position assurance system in an electrical connector of the character described.

SUMMARY OF THE INVENTION

An object, therefore, of the invention is to provide an electrical connector with a new and improved terminal position assurance (TPA) device.

In the exemplary embodiment of the invention, an electrical connector includes a housing having a front mating end, a rear terminating end and at least one terminal-receiving passage extending in a direction defining an insertion axis between the ends. The passage has a rear open end communicating with the rear terminating end of the housing. A TPA device is engageable with the housing at the front mating end thereof in a pre-load position and includes a through passage communicating with the terminal-receiving passage in the housing. The TPA device is movable rearwardly from the pre-load position to a locking position. A terminal is insertable through the rear terminating end of the housing into the rear open end of the terminal-receiving passage, along the insertion axis, and into the through passage in the TPA device for conjoint movement with the TPA device from the pre-load position to the locking position. Terminal locking means are provided and include a locking surface on the housing at the terminal-receiving passage and engageable with a locking shoulder on the terminal. Complementary interengaging ramp means are provided between the TPA device and the housing and extending at an angle to the axis for dropping the locking shoulder of the terminal onto the locking surface on the housing as the TPA device and the terminal moves conjointly from the pre-load position to the locking position angularly of the insertion axis.

As disclosed herein, the ramp means comprise a ramp surface on the TPA device engageable with a ramp surface on the housing. The ramp surfaces extend at an angle to the insertion axis.

According to one aspect of the invention, the TPA device includes a detent portion having the ramp surface on an outside thereof, with an inside of the detent portion having detent means engageable with detent means on the housing for holding the TPA device in the pre-load and locking positions. The detent portion is located at one side of the TPA device, and a locking arm is located at an opposite side of the TPA device. The locking arm is engageable with a locking shoulder on the terminal.

According to another aspect of the invention, a plurality of the terminal-receiving passages are provided in the housing aligned with a plurality of the through passages in the TPA device for receiving a plurality of the terminals in at least one row thereof. A plurality of locking arms are provided on the TPA device respectively engageable with locking shoulders on the terminals. A plurality of ramp arms are provided on the TPA device and having the ramp surfaces on the outside of the arms engageable with ramp surfaces on the housing. The ramp surfaces extend at an angle to the insertion axis. The ramp arms are located in a row at one side of the TPA device, and the locking arms are located in a row at an opposite side of the TPA device. The locking arms are aligned between the ramp arms. The ramp arms have the ramp surfaces on an outside thereof and detent means on an inside thereof. The detent means are engageable with complementary detent means on the housing for holding the TPA device in the pre-load and locking positions.

According to a further aspect of the invention, primary terminal locking means and secondary terminal locking means are provided for the terminal. The primary terminal locking means include a primary locking arm on the TPA device engageable with a locking shoulder on the terminal. The secondary terminal locking means include a secondary locking surface on the housing engageable with the locking shoulder on the terminal. Therefore, the single locking shoulder on the terminal performs a dual function of being part of both the primary terminal locking means and the secondary terminal locking means.

As disclosed herein, the locking shoulder on the terminal extends transversely of the insertion axis. The primary locking arm on the TPA device is engageable with the locking shoulder generally at the center thereof. The housing has a pair of the secondary locking surfaces engageable with the locking shoulder at opposite sides of the primary locking arm.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
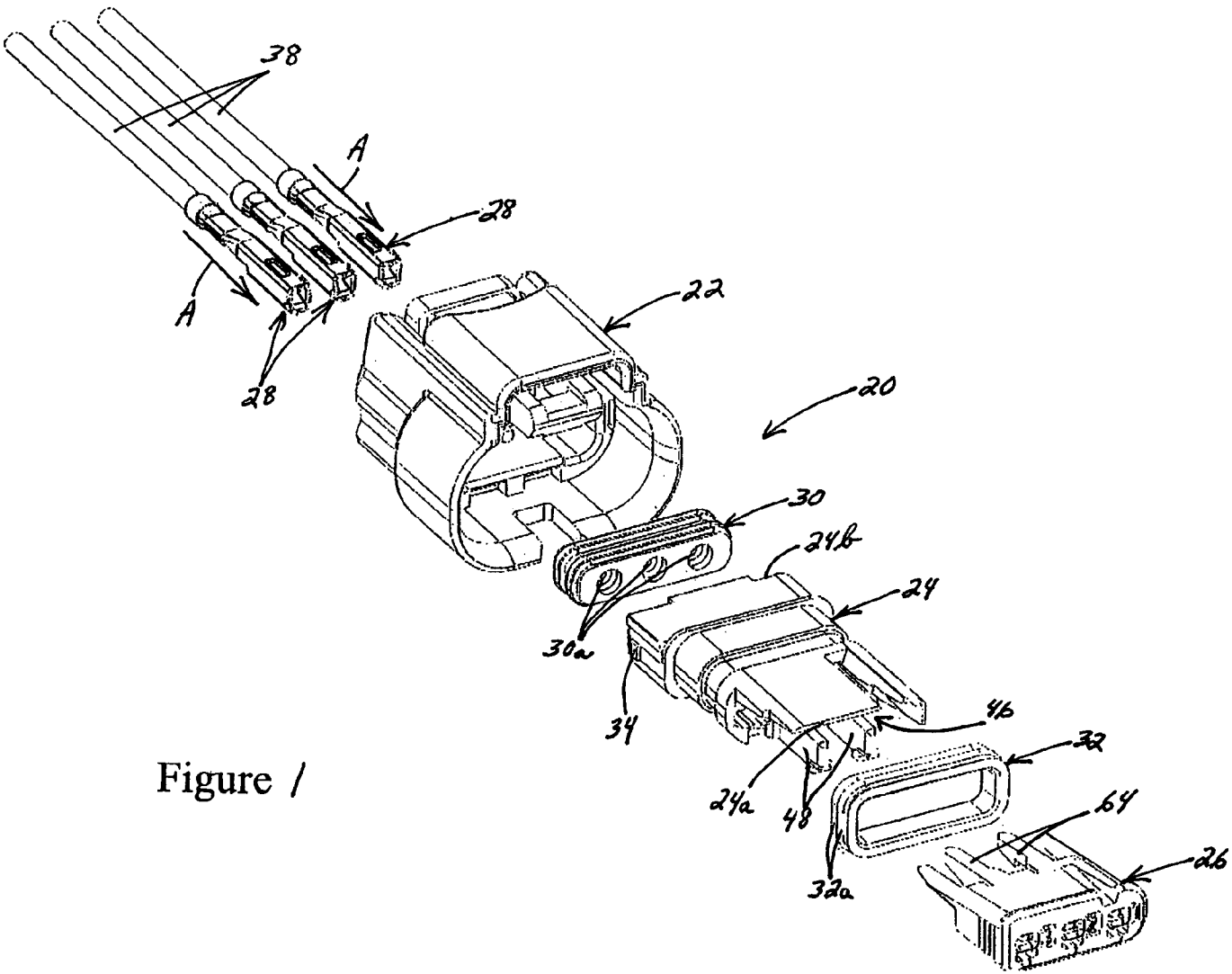
FIG. 1 is an exploded, front perspective view of an electrical connector incorporating the concepts of the invention.
Figure 2:
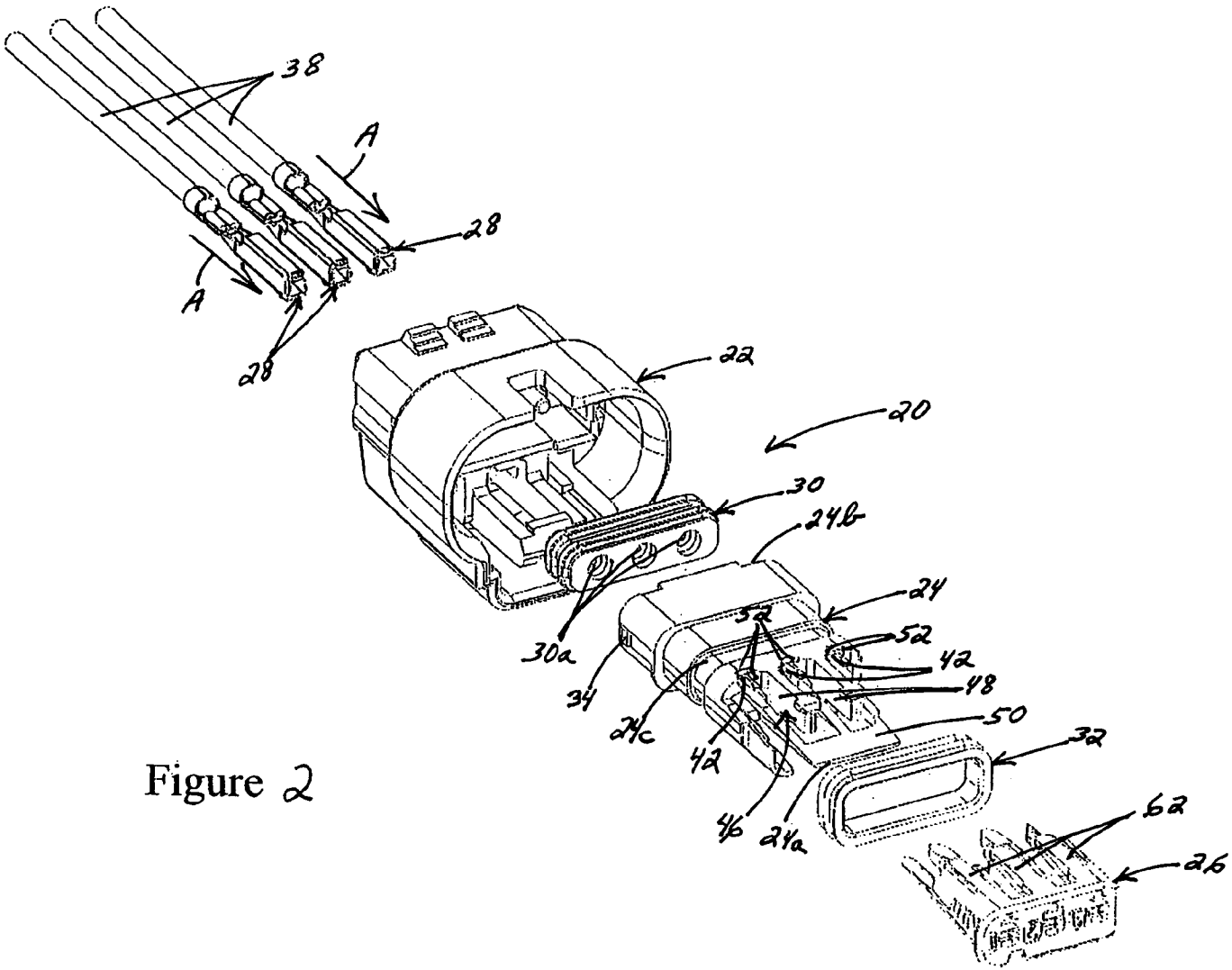
FIG. 2 is a view similar to that of FIG. 1, taken 180° from the direction of viewing in FIG. 1.
Figure 3:
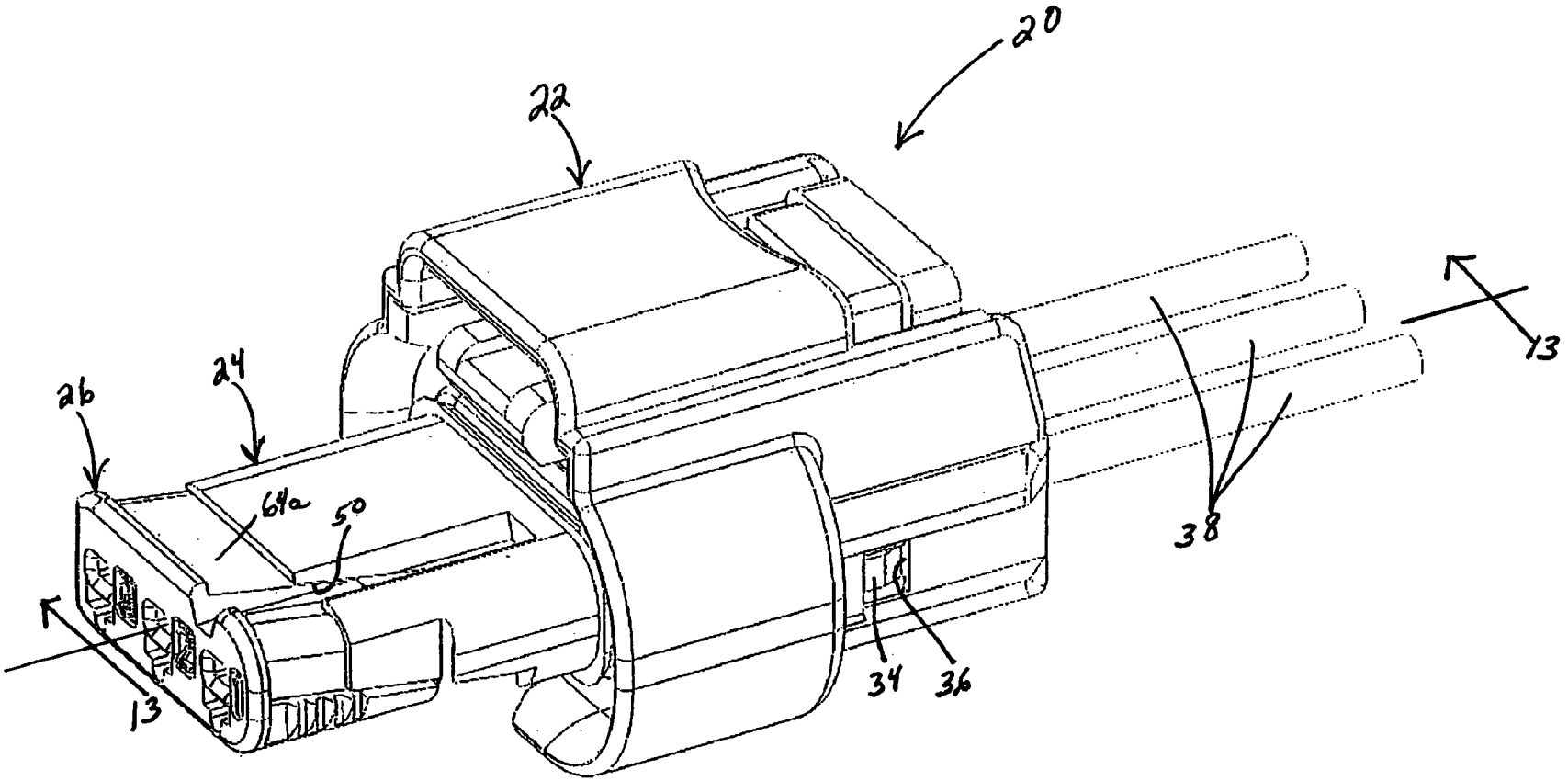
FIG. 3 is a top perspective view of the connector in assembled condition, with the TPA device in its pre-load position.

Referring to the drawings in greater detail, and first to FIGS. 1 and 2, the invention is embodied in an electrical connector, generally designated 20 (FIG. 3), which includes an outer grommet cap or shroud, generally designated 22; an inner housing, generally designated 24; a terminal position assurance (TPA) device, generally designated 26 and engageable with the front of the housing; a plurality of terminals, generally designated 28 and insertable into the connector in the direction of arrows "A"; a wire seal, generally designated 30; and a perimeter seal, generally designated 32. All of these components shown in FIGS. 1 and 2 are assembled as shown in FIG. 3, with TPA device 26 being engaged at the front mating end of housing 24 in a pre-load position. FIG. 3 shows how shroud 22 is assembled over housing 24 by means of a pair of chamfered latch bosses 34 on opposite sides of the housing which snap into a pair of latch openings 36 in opposite sides of the shroud.

Such terms as "top", "bottom", "upwardly", "downwardly" and the like herein and in the claims hereof as used solely to provide a clear and concise understanding of the invention in relation to the depictions in the drawings. These terms are not in any way meant to be limiting because the connector herein, obviously, is omni-directional in construction, assembly and use.

Figure 4:
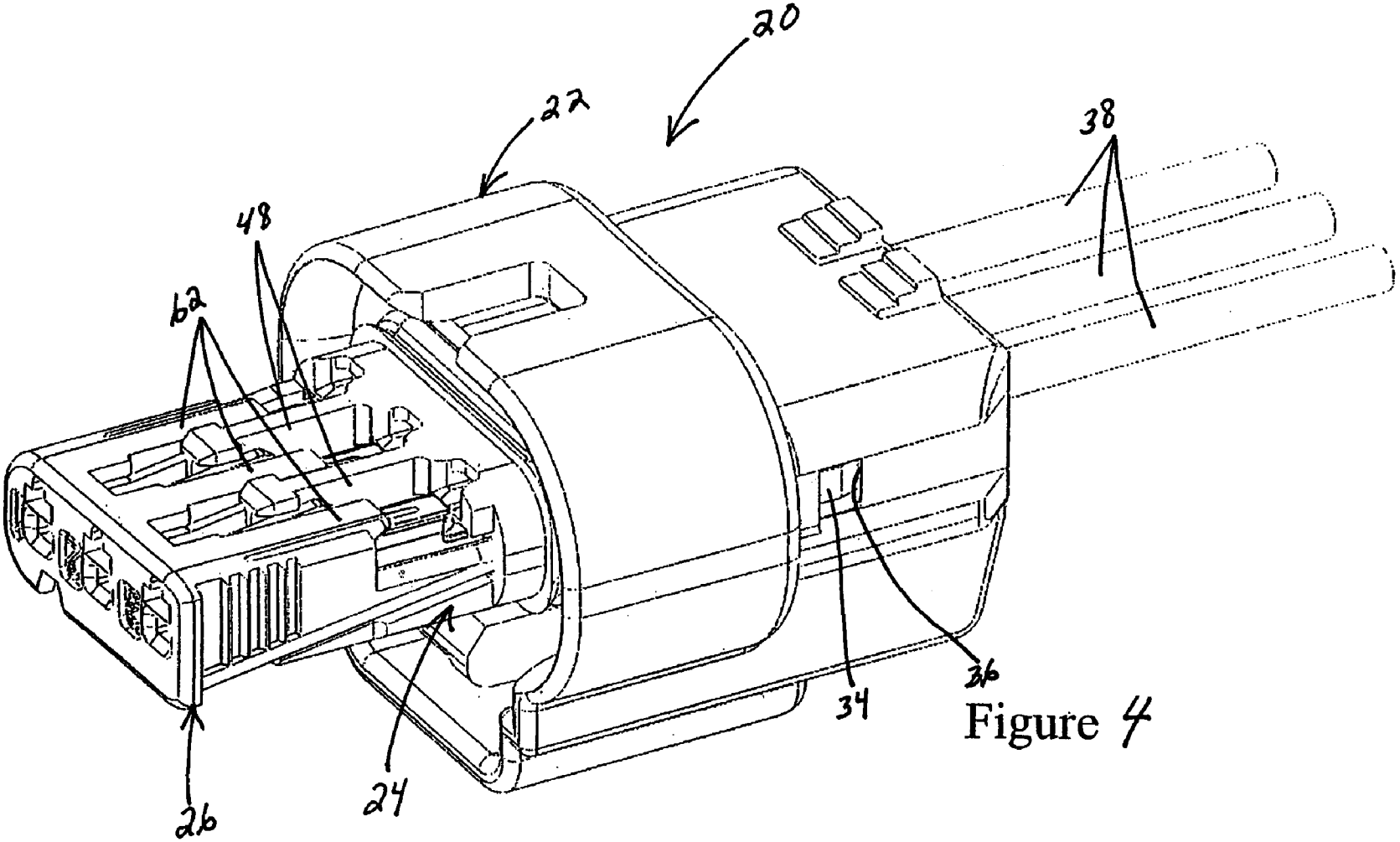
FIG. 4 is a bottom perspective view similar to FIG. 3.
Figure 5:
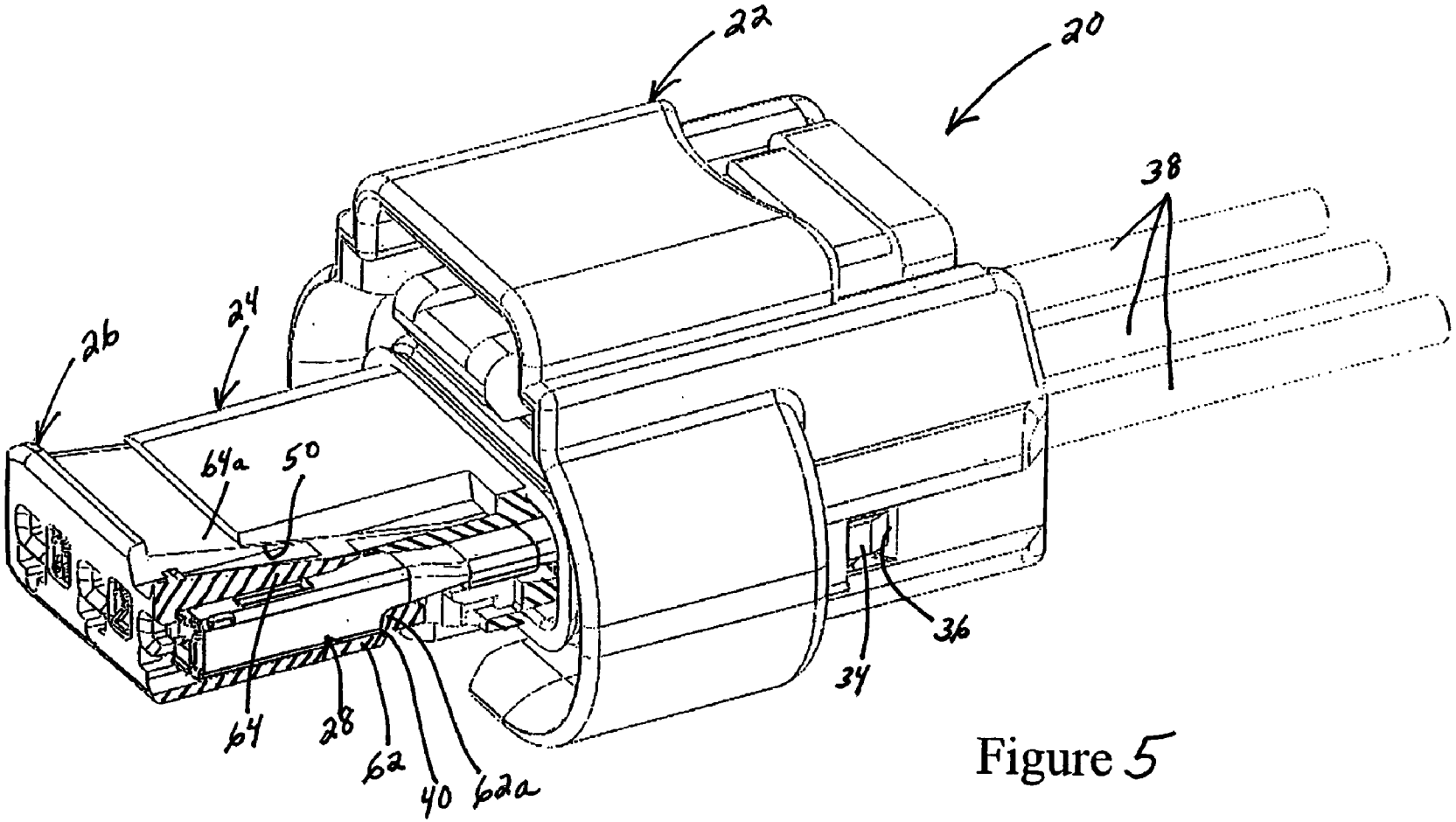
FIG. 5 is a view similar to that of FIG. 3, but partially in section.

FIGS. 3–5 all show TPA device 26 in its pre-load position. It can be seen in FIG. 5 that terminals 28 have been inserted through the rear of the connector all the way forward and into the TPA device, with the TPA device in its pre-load position.

Figure 6:
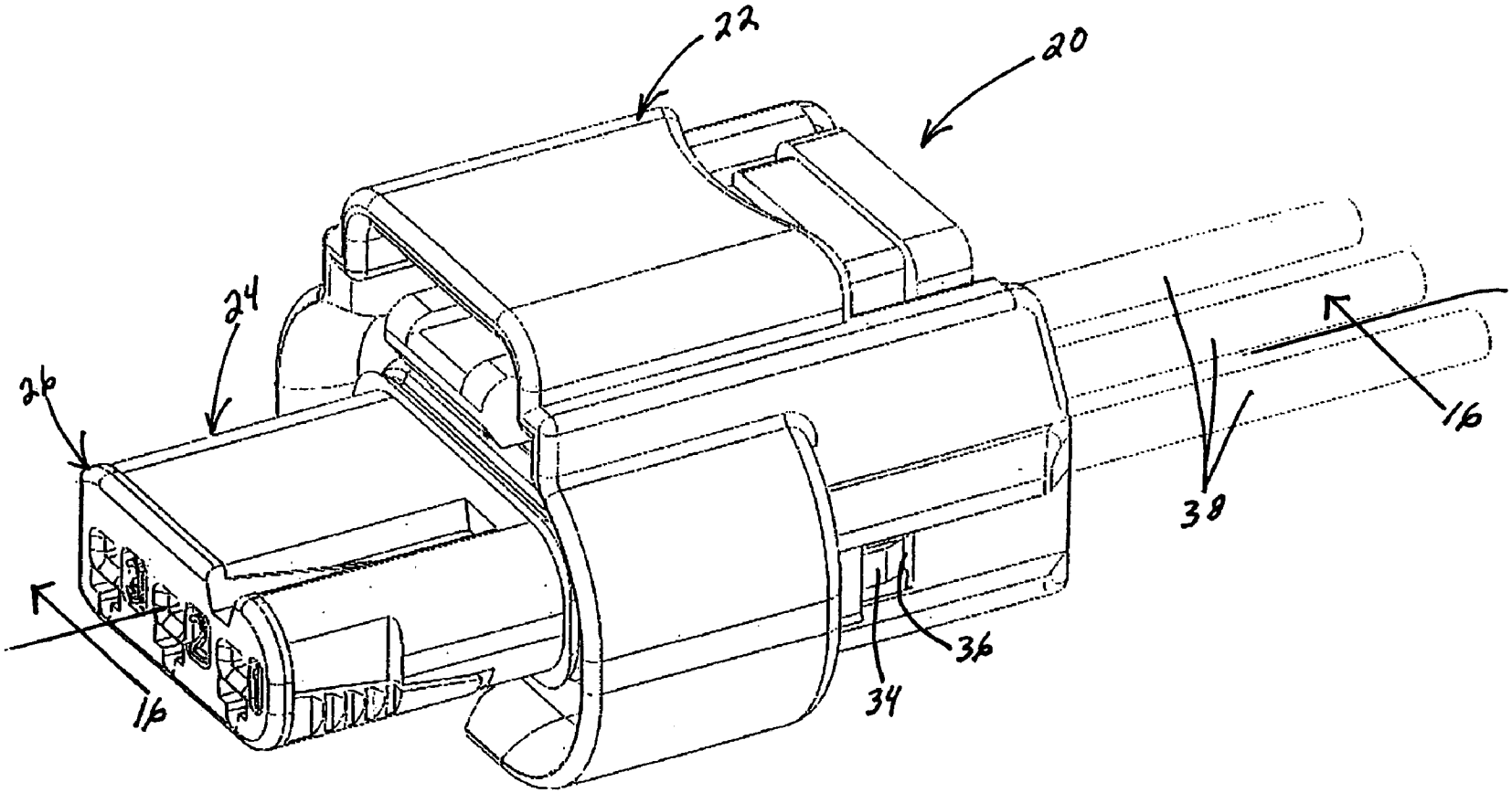
FIGS. 6–8 are views similar to FIGS. 3–5, respectively, but with the TPA device in its locked position.
Figure 7:
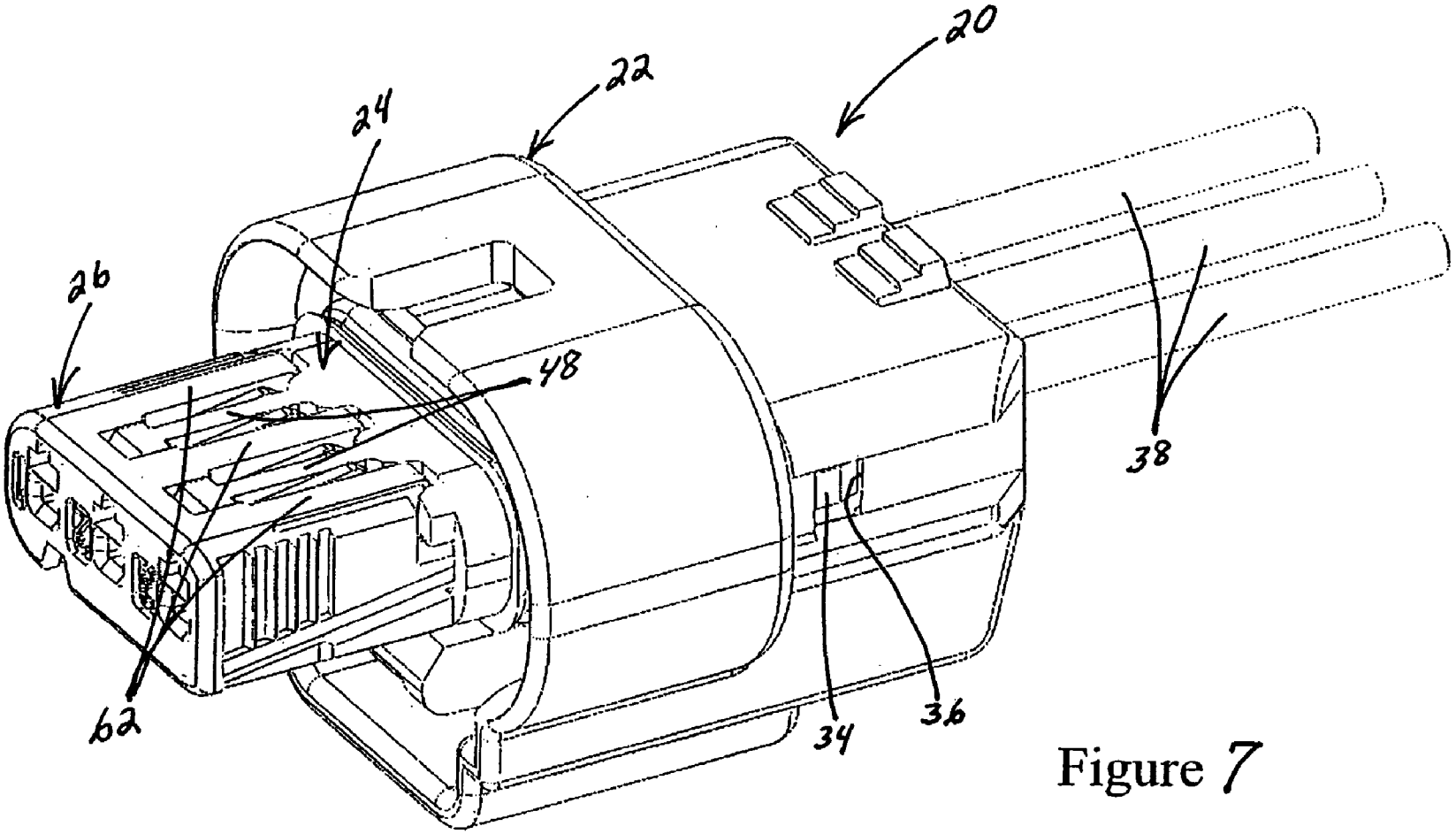
Figure 8:
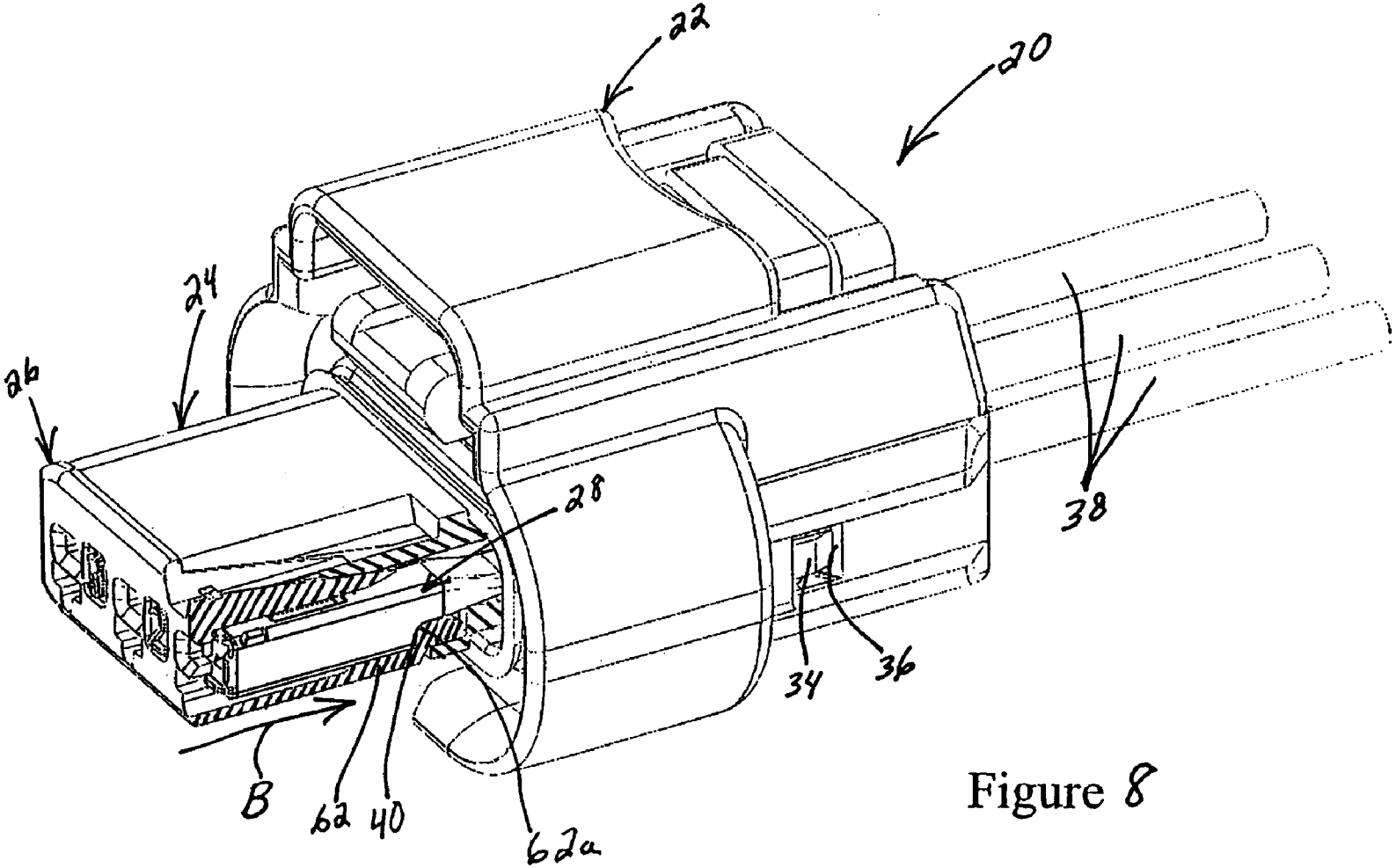

Once the terminals are completely inserted forwardly into TPA device 26 (FIGS. 3–5), the TPA device and terminals are moved conjointly rearwardly to a locking position shown in FIGS. 6–8. It can be seen in FIG. 8 that terminals 28 move with TPA device 26 rearwardly into housing 28 in the direction of arrow "B" from the pre-load position (FIGS. 3–5) to the locking position (FIGS. 6–8).

Figure 9:
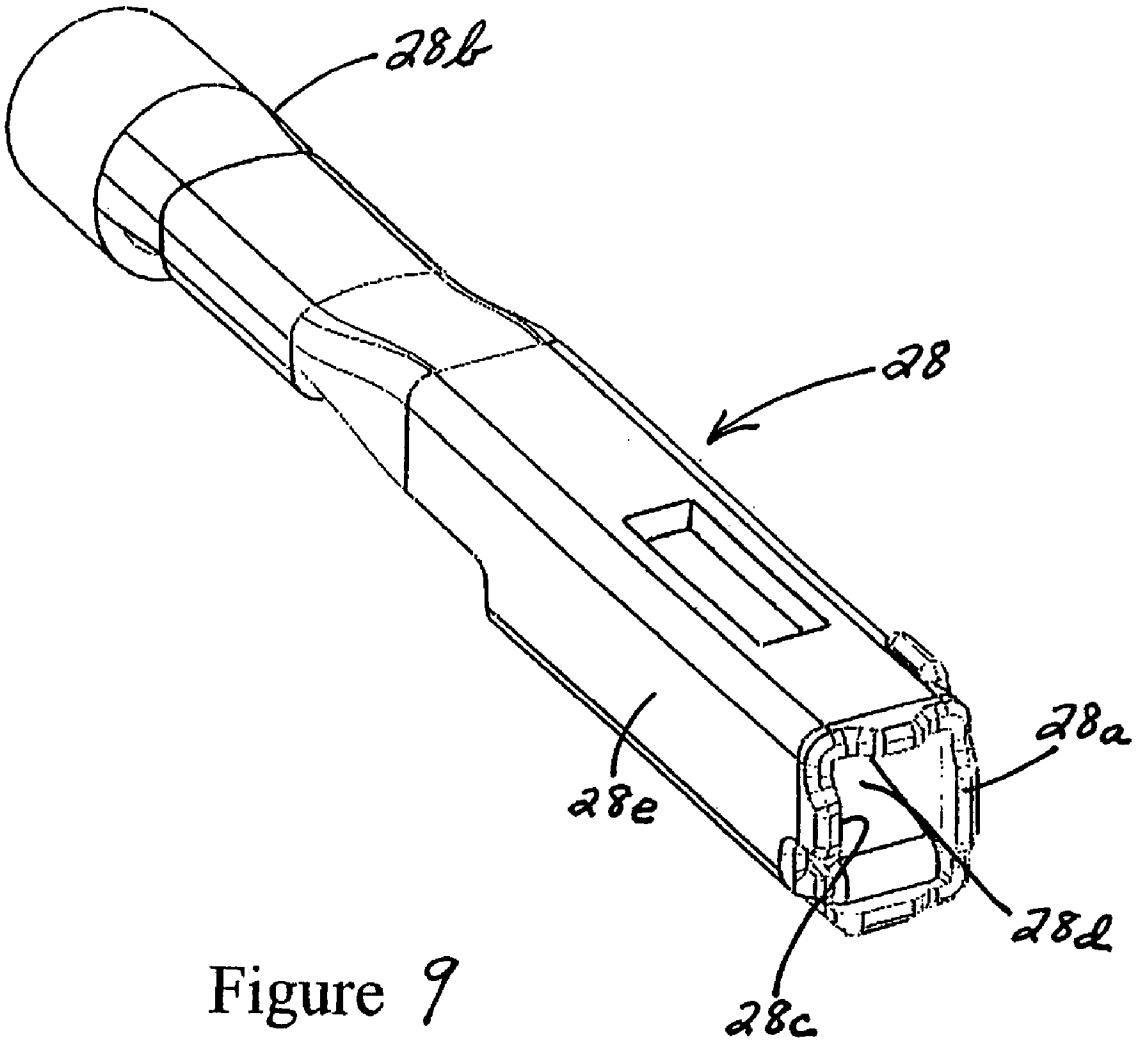
FIG. 9 is an enlarged perspective view of one of the terminals shown in FIG. 1.
Figure 10:
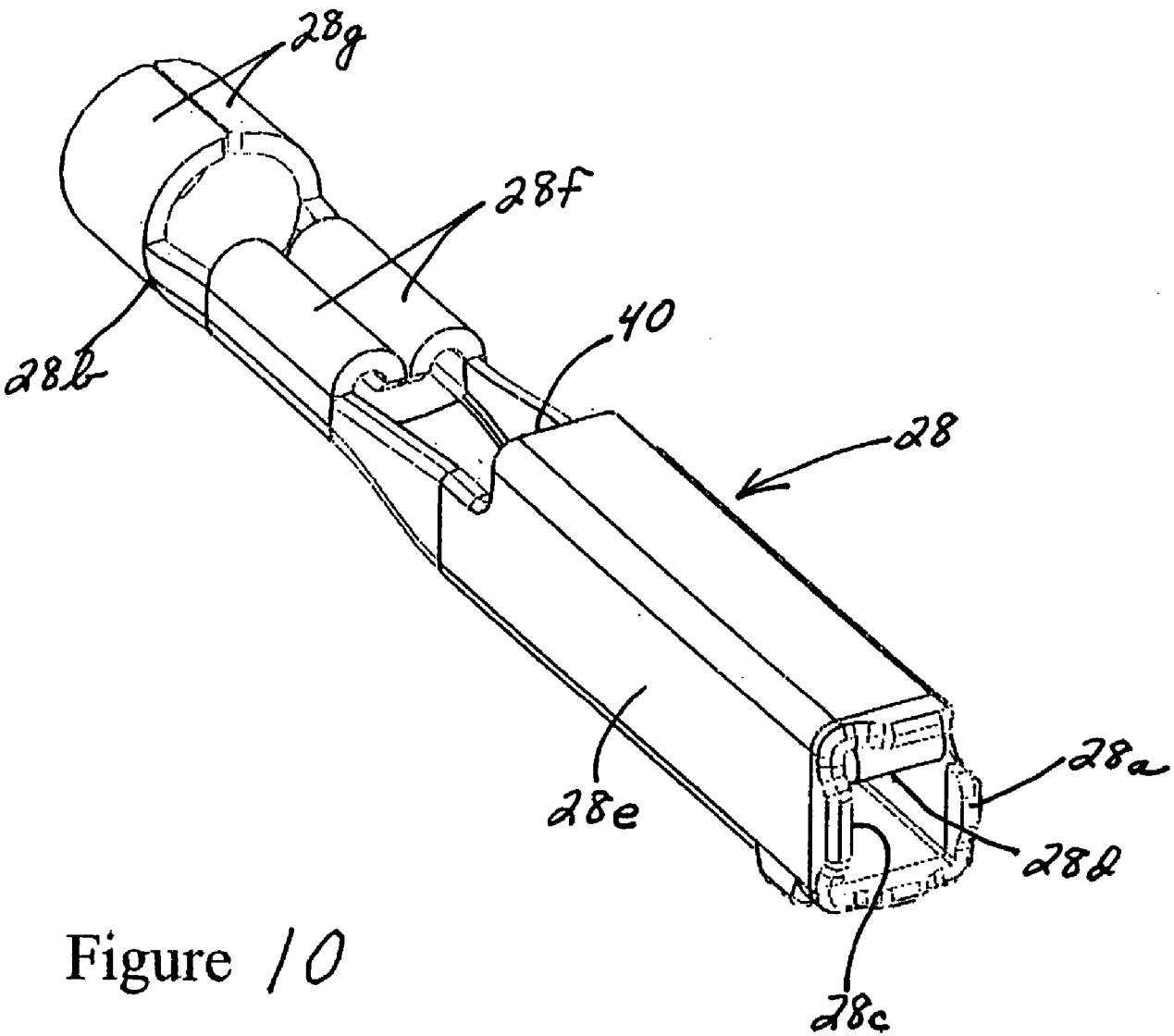
FIG. 10 is an enlarged perspective view of the terminal shown in FIG. 2.
Figure 11:
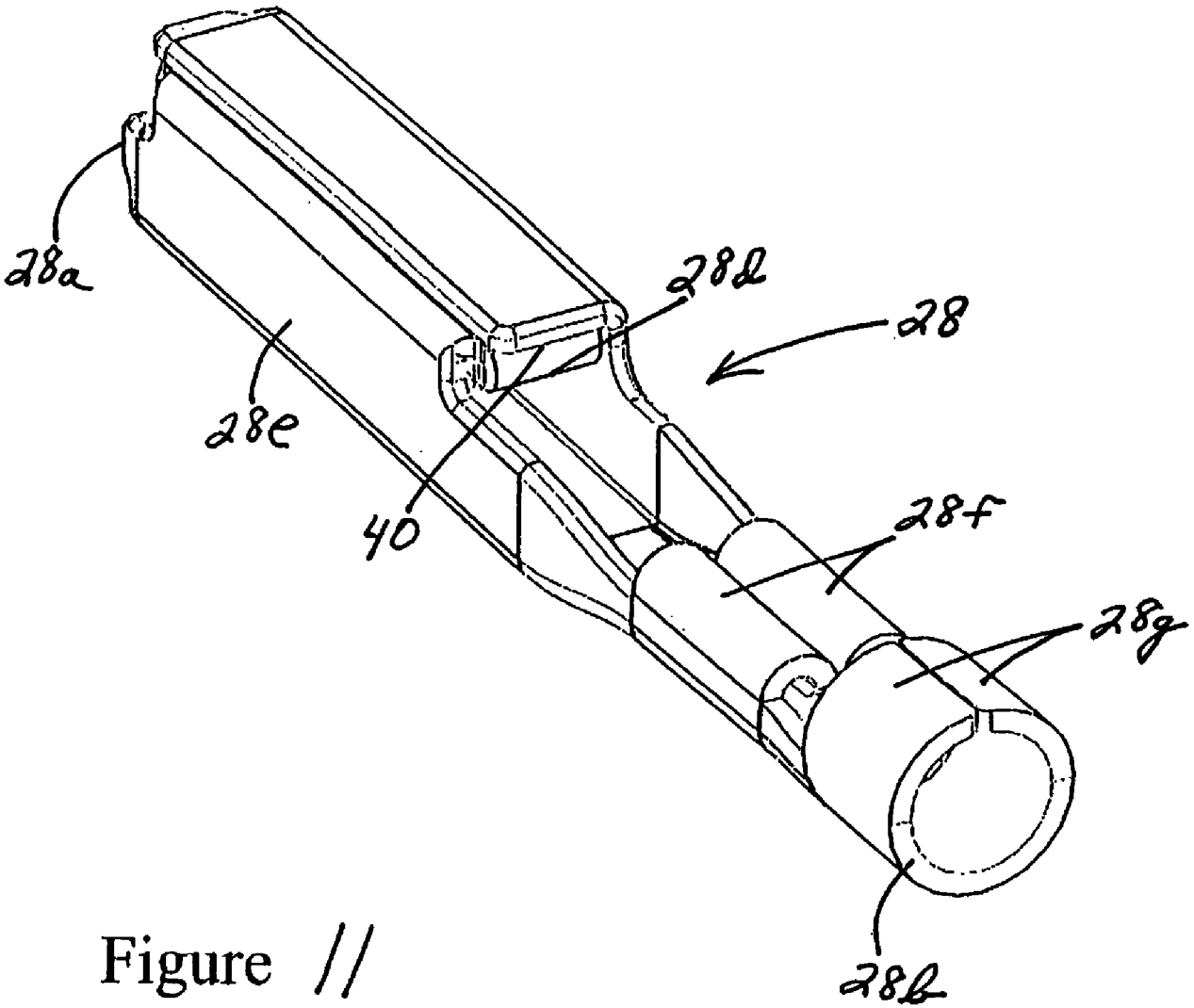
FIG. 11 is a perspective view of the terminal looking toward the rear of the depiction in FIG. 10.

Referring to FIGS. 9–11, each terminal 28 includes a front mating end 28*a* and a rear terminating end 28*b*. Terminal 28 is a female terminal, and front mating end 28*a* defines an opening 28*c* for receiving a terminal pin from a complementary mating connector. The terminal may be stamped and formed from conductive sheet metal material, and flexible contact arms 28*d* are located within a box-like body 28*e* for engaging the terminal pin. Rear terminating end 28*b* of the terminal includes two pairs 28*f* and 28*g* of crimp arms for terminating an insulated electrical wire 38 (FIGS. 1 and 2). Crimp arms 28*f* clamp onto the inner conductor or core of the electrical wire, and crimp arms 28*g* clamp onto the outer insulating cladding of the wire.

Finally, FIG. 11 shows that each terminal 28 has a single, rearwardly facing locking shoulder 40 which performs a dual function of being a primary locking shoulder as well as a secondary locking shoulder, as will be understood hereinafter.

Figure 12:
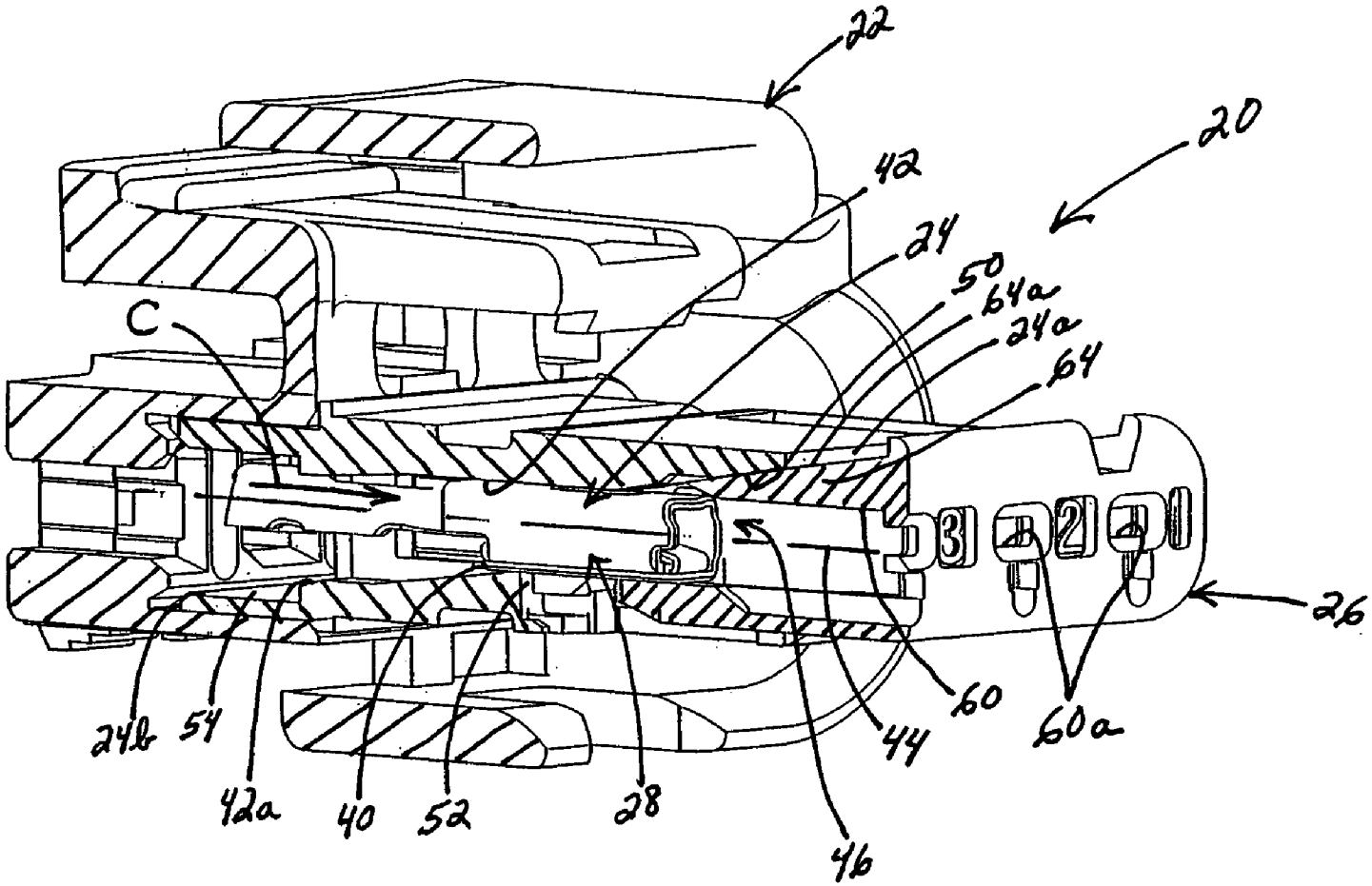
FIG. 12 is an enlarged perspective view, in section, showing one of the terminals in the process of being inserted into the connector and with the TPA device in its pre-load position.

Referring back to FIGS. 1 and 2 in conjunction with FIG. 12, housing 24 is a one-piece structure of insulating or dielectric material such as molded plastic. The housing has a front mating end 24*a* and a rear terminating end 24*b*. A plurality (three) of terminal-receiving passages 42 extend in a direction defining an insertion axis 44 extending between front end 24*a* and rear end 24*b* of the housing. The passages have rear open ends 42*a* communicating with rear terminating end 24*b* of the housing. Front mating end 24*a* of the housing has an open receptacle area, generally designated 46, which receives TPA device 26 as seen in FIG. 12. It can be seen in FIG. 2 that receptacle area 46 not only is open at front mating end 24*a* of the housing, but the receptacle area is open at one side of the housing. The housing has a pair of chamfered detent arms 48 located at the open one side of receptacle area 46, for purposes described hereinafter. The housing has a ramp surface 50 at an opposite side of receptacle area 46 and facing inwardly toward insertion axis 44, for purposes described hereinafter. The housing has a pair of secondary locking surfaces 52 at opposite sides of each terminal-receiving passage 42 and facing forwardly toward open receptacle area 46, again for purposes described hereinafter. Finally, housing 24 has a peripheral groove 24*c* into which perimeter seal 32 is fixed. The seal has ridges 32*a* about the periphery thereof for engaging the complementary mating connector. Wire seal 30 is disposed within an open area 54 (FIG. 12) at the rear of the housing and includes a plurality of passages 30*a* through which electrical wires 38 extend and are sealed about the periphery thereof.

FIG. 12 shows one of the terminals 28 in the process of being inserted in the direction of arrow "C" into the rear open end 42*a* of one of the terminal-receiving passages 42 from the rear terminating end 24*b* of housing 24. The terminal is about to enter TPA device 26, and locking shoulder 40 on the terminal has not yet passed secondary locking surfaces 52 of the housing. In essence, the terminal is inserted on insertion axis 44 which generally is defined by the center-line of passage 42.

Still referring to FIGS. 1 and 2 in conjunction with FIG. 12, TPA device 26 also is a one-piece structure which may be molded of dielectric plastic material. The TPA device is engageable within open receptacle area 46 of housing 24 and includes a plurality (three) of through passages 60 into which terminals 28 are inserted as best seen in FIG. 12. The passages have open front ends 60*a* for receiving the terminal pins of the complementary mating connector. The TPA device has three primary terminal locking arms 62 (FIG. 2) at one side thereof and aligned with passages 60. The TPA device has a pair of detent/ramp arms 64 (FIG. 1) at an opposite side thereof. Arms 64 are called "detent/ramp" arms because they perform dual functions of providing detent means (described hereinafter) which define the pre-load and locking positions of the TPA device as well as providing a ramping means for guiding the TPA device at an angle to insertion axis 44 in its movement between those positions. Specifically, FIG. 12 shows a top ramp surface 64*a* in engagement with ramp surface 50 of housing 24.

Figure 13:
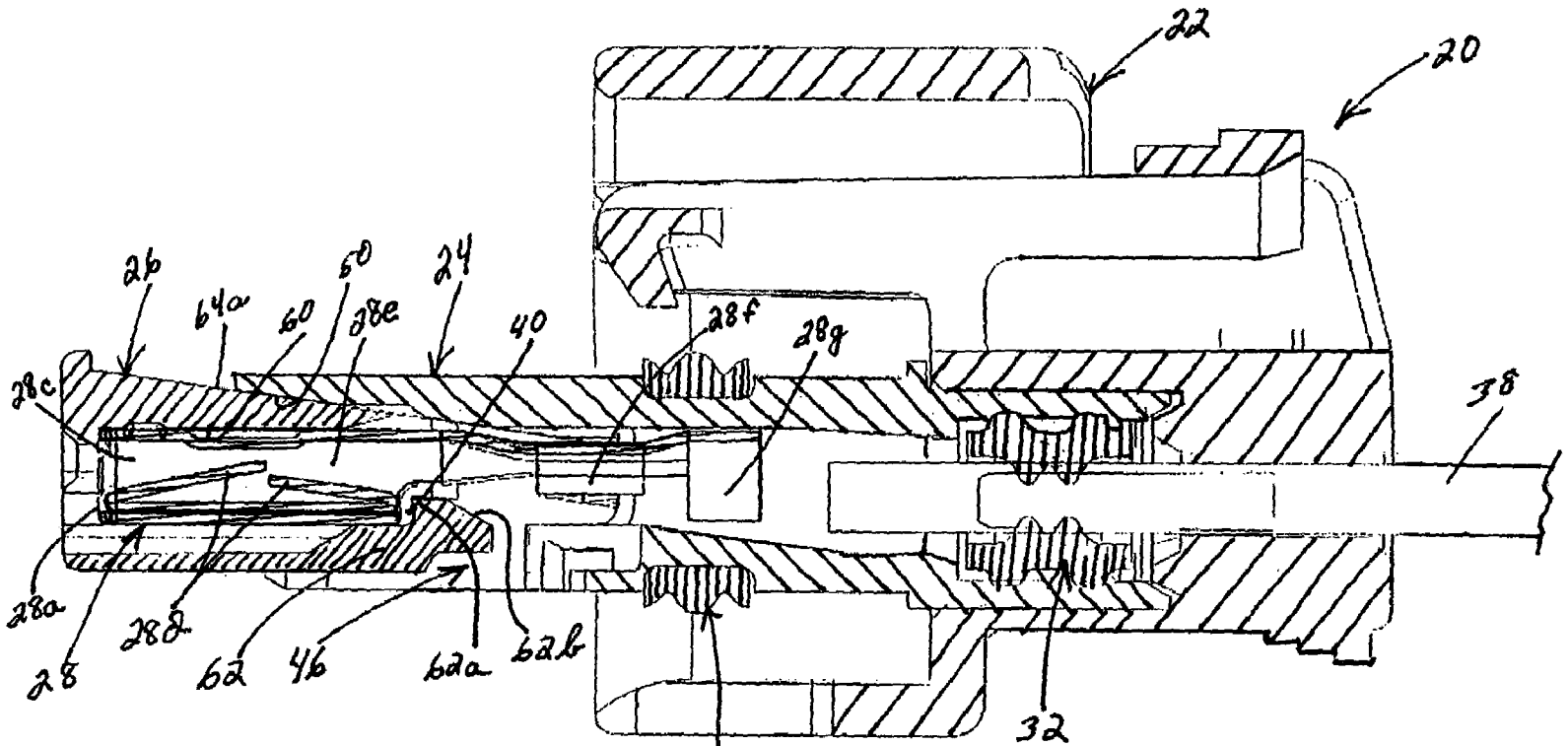
FIG. 13 is a vertical section taken generally along line 13—13 in FIG. 3.
Figure 14:
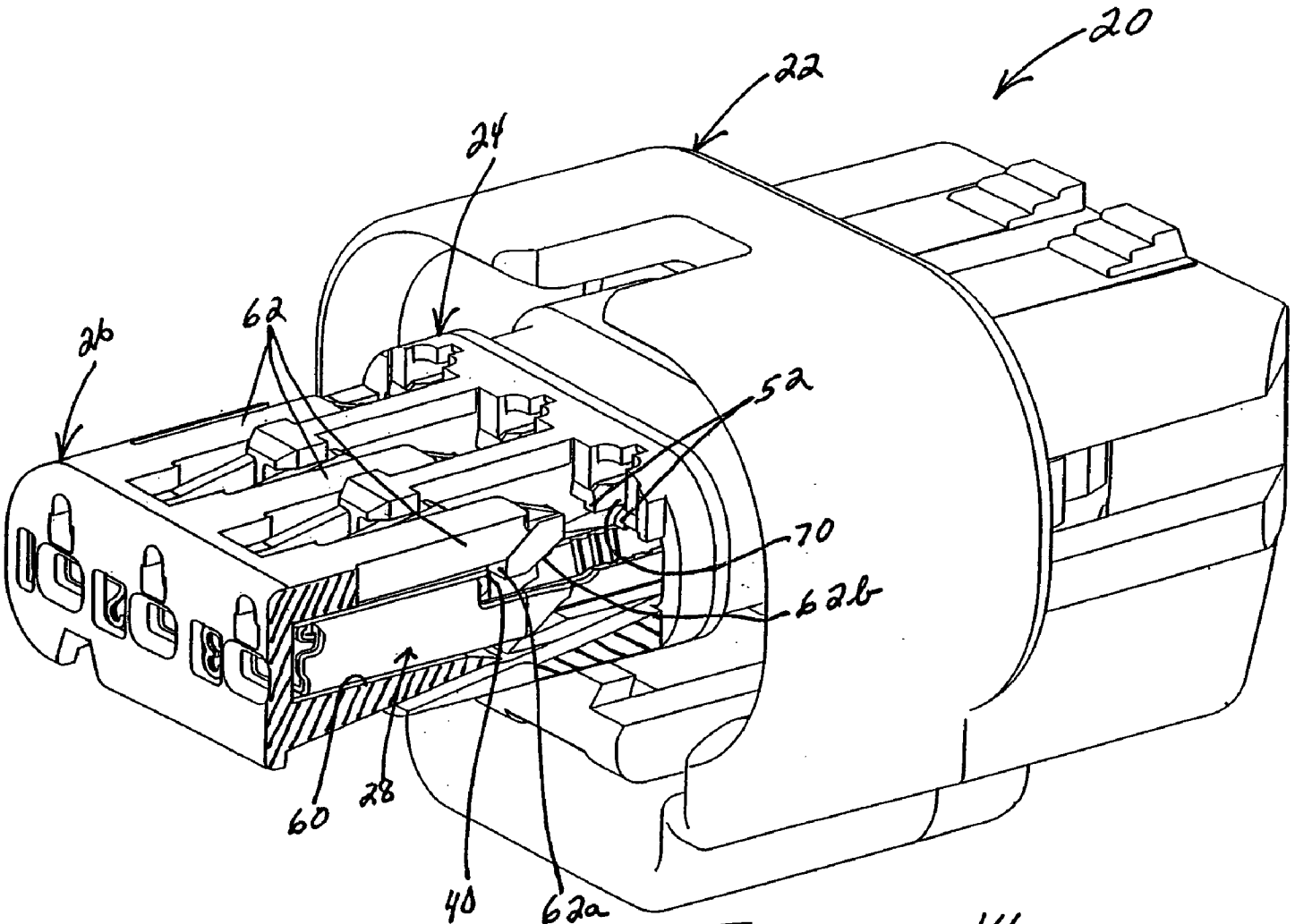
FIG. 14 is an enlarged perspective view similar to that of FIG. 4, but partially in section.
Figure 15:
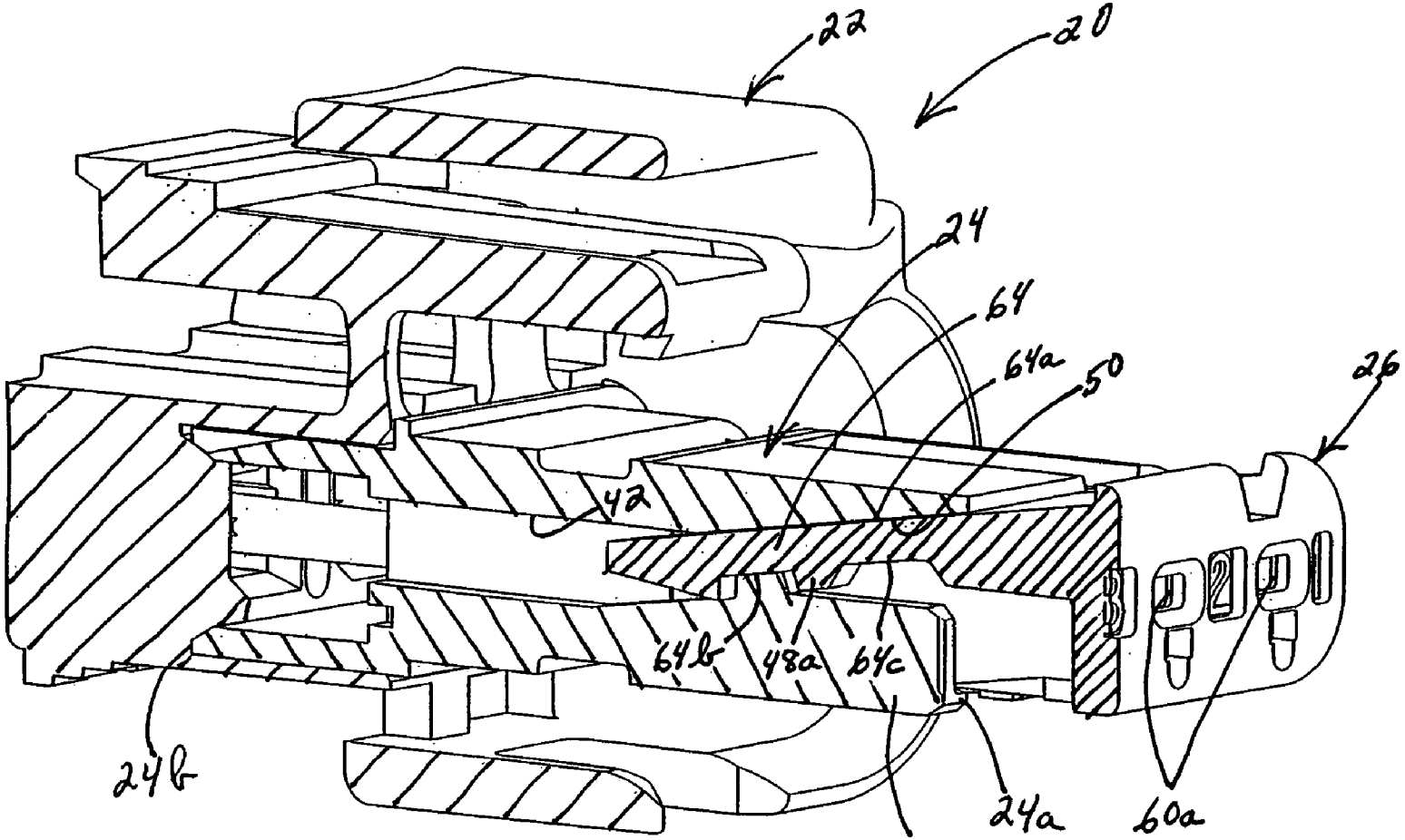
FIG. 15 is an enlarged section showing the detent means between the TPA device and the housing, with the TPA device in its pre-load position.

FIGS. 13–15 show TPA device 26 in its pre-load position relative to housing 24. Terminals 28 have been inserted completely forwardly into through passages 60 in the TPA device. Primary terminal locking means are provided to lock each terminal in its passages. Specifically, as best seen in FIGS. 13 and 14, each locking arm 62 on the TPA device includes a locking hook 62*a* which engages locking shoulder 40 on the respective terminal. Locking arm 62 is flexible, and locking hook 62*a* is chamfered, as at 62*b*. Therefore, the locking hook automatically snaps into locking engagement with the terminal as the terminal is fully inserted into the TPA device. It can be seen in FIG. 13 that flexible locking arms 62 can flex freely outside housing 24 through one side of open receptacle area 46. Therefore, the housing does not have to be enlarged to accommodate the flexing of the locking arms.

FIG. 15 shows a detent boss 48*a* on one of the detent arms 48 disposed within a detent recess 64*b* on the inside of one of the detent/ramp arms 64 of TPA device 26. This detent means defines the pre-load position of the TPA device and holds the TPA device in that position. Before proceeding, FIG. 14 clearly shows the secondary locking surfaces 52 on the housing for engaging locking shoulder 40 of the respective terminal 28, as describe below. There is an open area 70 of the housing between the secondary locking surfaces for receiving the front end of locking arm 62 of the TPA device when the TPA device is moved to the locking position, as describe below.

Figure 16:
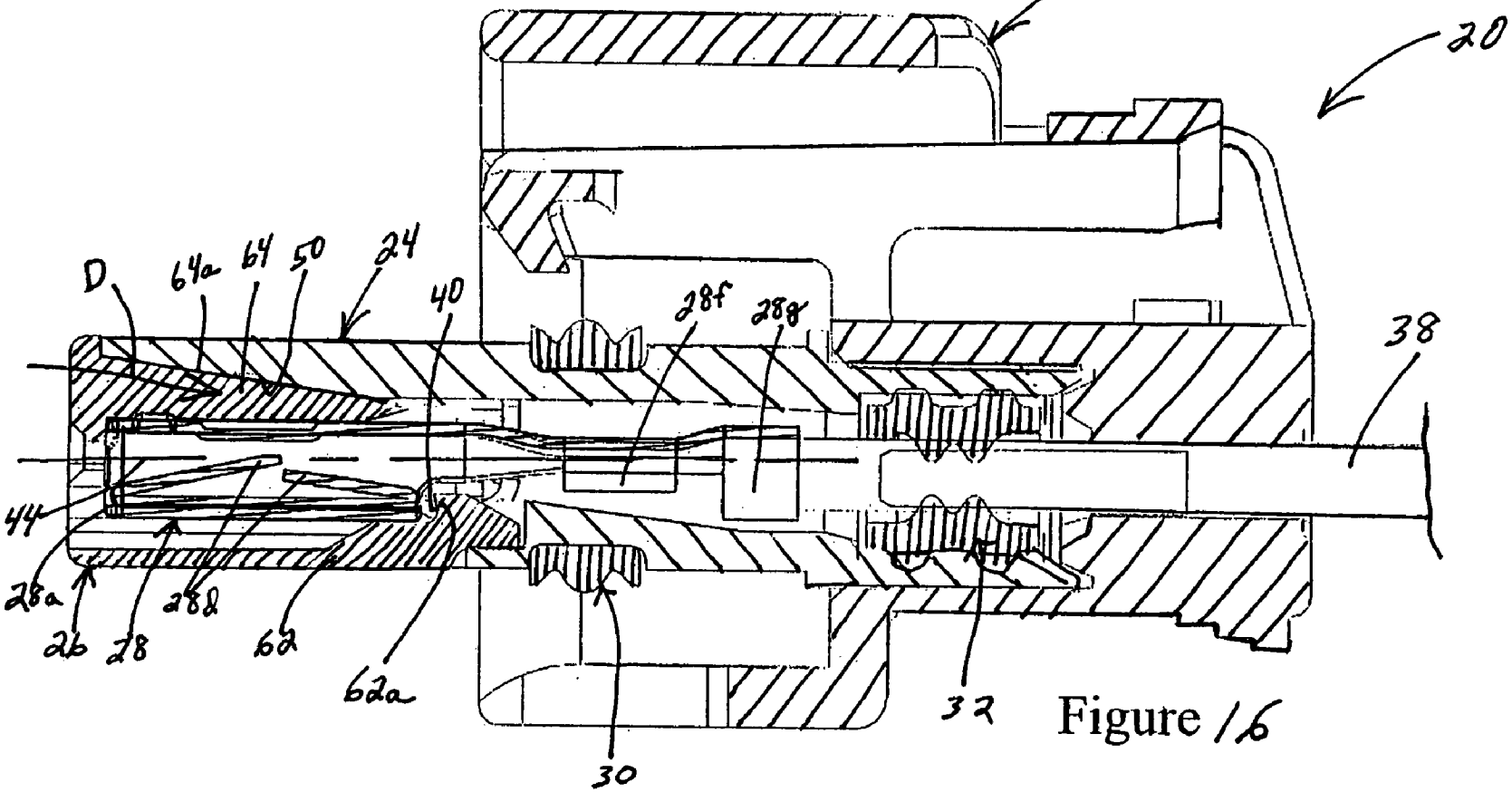
FIGS. 16–18 are views similar to that of FIGS. 13–15, respectively, but with the TPA device in its locked position.
Figure 17:
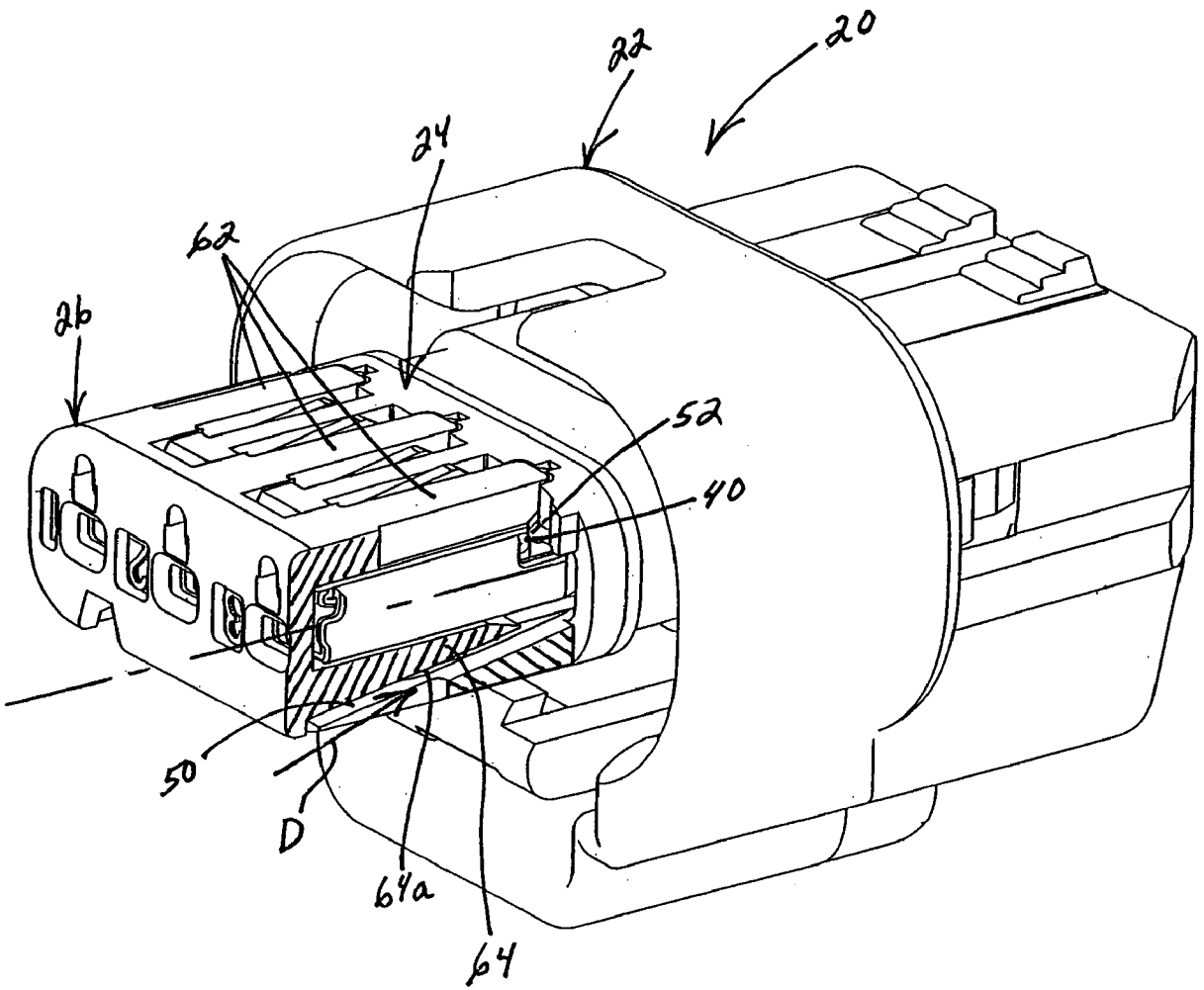
Figure 18:
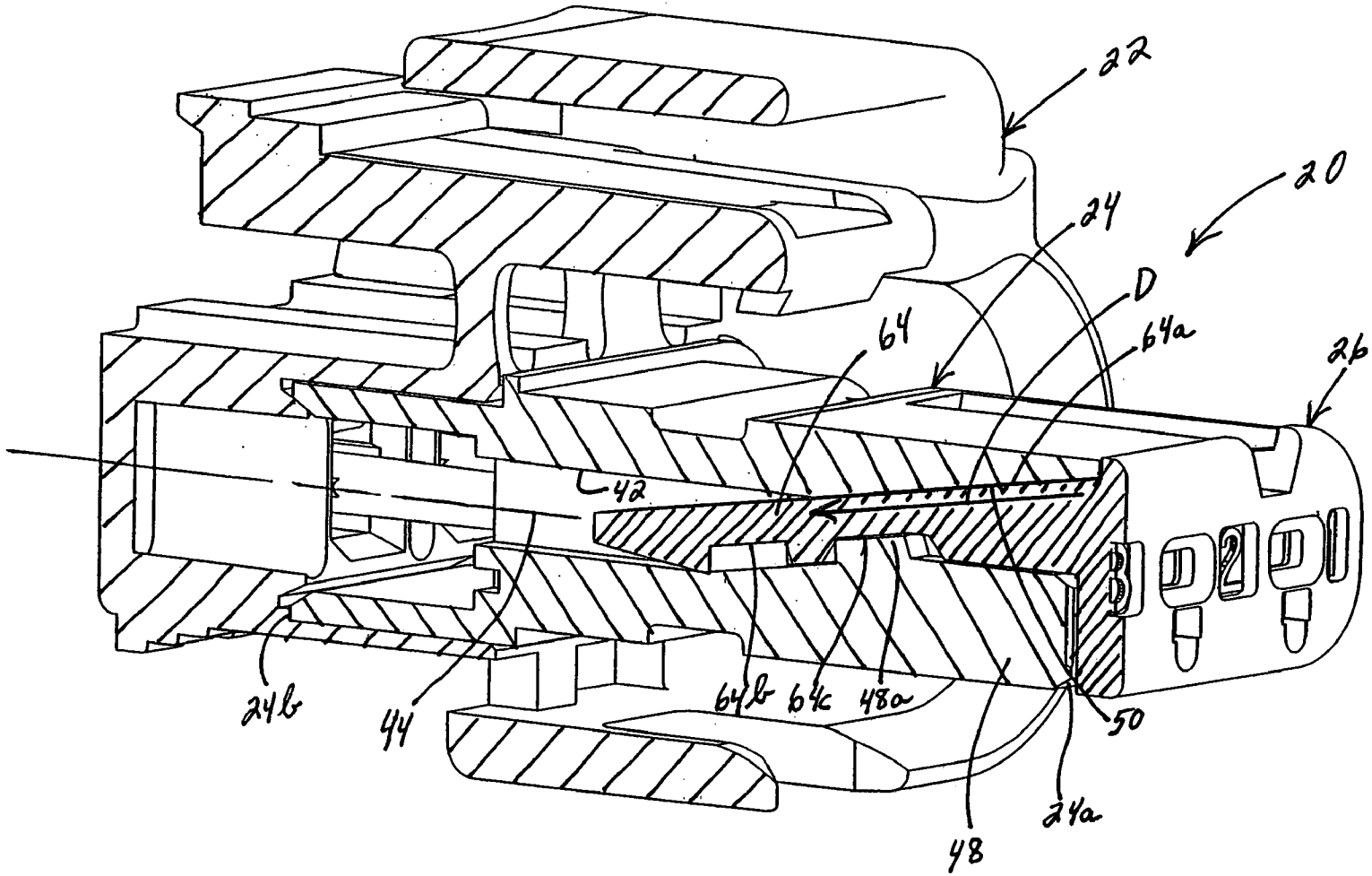

FIGS. 16–18 show TPA device 26 having been moved n the direction of arrows "D" from the pre-load position of FIGS. 13–15 to the locking position shown in FIGS. 16–18. As best seen in FIG. 18, it can be seen that ramp surfaces 64*a* on detent/ramp arms 64 of the TPA device slide along ramp surface 50 of the housing to guide the TPA device in an angular direction relative to insertion axis 44. As viewed in FIG. 18, the interengagement of ramp surfaces 64*a* and 50 guide the TPA device downwardly and inwardly toward insertion axis 44. This motion is effective to drop locking shoulder 40 on each terminal 28 into engagement with secondary locking surfaces 52 on the housing. If reference is made back to FIG. 12, it can be understood that when terminal 28 is inserted along insertion axis 44 in the direction of arrow "C", locking shoulder 40 on the terminal simply passes by secondary locking surfaces 52 on the housing as the terminal moves into passage 60 in the TPA device which is in its pre-load position. However, when the TPA device and the terminal move conjointly from the pre-load position to the locking position, the TPA device and the terminal(s) move angularly toward axis 44 to move locking shoulder 40 into engagement with secondary locking surfaces 52 of the housing. FIG. 18 shows detent boss 48*a* disposed within a detent recess 64*c* on the inside of the detent/ramp arm 64 of TPA device 26 to define the locking position of the TPA device and hold the device thereat.

Finally, it should be noted that locking shoulder 40 (FIG. 11) on each terminal extends transversely to the longitudinal insertion axis of the terminal. This locking shoulder is wide enough to perform a dual function of being part of the both the primary terminal locking means and the secondary terminal locking means of the connector assembly. Specifically, locking hook 62*a* (FIG. 14) on locking arm 62 of the TPA device engages a central portion of locking shoulder 40 but leaves sufficient area of the locking shoulder at opposite ends thereof for engaging secondary locking surfaces 62 of the housing.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector, comprising:

a housing having a front mating end, a rear terminating end and at least one terminal-receiving passage extending in a direction defining an insertion axis extending between said ends, the passage having a rear open end communicating with the rear terminating end of the housing;

a TPA device engageable with the housing at said front mating end thereof in a pre-load position and including a through passage communicating with the terminal-receiving passage in the housing, the TPA device being movable rearwardly from said pre-load position to a locking position;

a terminal insertable through the rear terminating end of the housing into the rear open end of the terminal-receiving passage along said insertion axis and into the through passage in the TPA device for conjoint movement with the TPA device from said pre-load position to said locking position;

terminal locking means including a locking surface on the housing at said terminal-receiving passage and engageable with a locking shoulder on the terminal; and complementary interengaging ramp means between the TPA device and the housing and extending at an angle to said axis for moving the locking shoulder of the terminal transversely of said axis onto the locking surface on the housing as the TPA device and the terminal move conjointly from said pre-load position to said locking position angularly of said axis.

2. The electrical connector of claim 1 wherein said ramp means comprise a ramp surface on the TPA device engageable with a ramp surface on the housing, the ramp surfaces extending at an angle to said axis.

3. The electrical connector of claim 2 wherein said TPA device includes a detent portion having said ramp surface on an outside thereof, with an inside of the detent portion having detent means thereon engageable with detent means on the housing for holding the TPA device in said pre-load and locking positions.

4. The electrical connector of claim 3 wherein said detent portion is located at one side of the TPA device, and including a locking arm on an opposite side of the TPA device, the locking arm being engageable with a locking shoulder on the terminal.

5. The electrical connector of claim 1, including a plurality of said terminal-receiving passages in the housing aligned with a plurality of said through passages in the TPA device for receiving a plurality of said terminals in at least one row thereof, a plurality of locking arms on the TPA device respectively engageable with locking shoulders on the terminals, and a plurality of ramp arms on the TPA device and having said ramp means thereon.

6. The electrical connector of claim 5 wherein said ramp means comprise ramp surfaces on the outside of the ramp arms engageable with ramp surfaces on the housing, the ramp surfaces extending at an angle to said insertion axis.

7. The electrical connector of claim 6 wherein said ramp arms are located in a row at one side of the TPA device, and said locking arms are located in a row at an opposite side of the TPA device, the locking arms being aligned between the ramp arms.

8. The electrical connector of claim 7 wherein said ramp arms having said ramp surfaces on an outside thereof and detent means on an inside thereof, the detent means being engageable with complementary detent means on the housing for holding the TPA device in said pre-load and locking positions.

9. The electrical connector of claim 8 wherein said detent means comprise at least one chamfered detent boss on one of the housing or detent arms engageable in detent recesses in the other of the housing or detent arms.

10. The electrical connector of claim 8 wherein said housing has a row of detent arms aligned with said ramp arms on the TPA device and having said complementary detent means thereon.

11. An electrical connector, comprising:

a housing having a front mating end, a rear terminating end and at least one terminal-receiving passage extending in an insertion direction between the ends, the passage having a rear open end communicating with the rear terminating end of the housing;

a terminal insertable into the rear open end of the passage from the rear terminating end of the housing;

a TPA device engageable with the housing;

primary terminal locking means including a primary locking arm on the TPA device engageable with a locking shoulder on the terminal; and secondary terminal locking means including a secondary locking surface on the housing engageable with said locking shoulder on the terminal, whereby said single locking shoulder on the terminal performs a dual function of being part of both said primary terminal locking means and said secondary terminal locking means.

12. The electrical connector of claim 11 wherein said locking shoulder on the terminal extends transversely of the insertion direction of the terminal, said primary locking arm on the TPA device being engageable with the locking shoulder generally at the center thereof, and the housing has a pair of said secondary locking surfaces engageable with the locking shoulder at opposite sides of the primary locking arm.

13. An electrical connector, comprising:

a housing having a front mating end, a rear terminating end and at least one terminal-receiving passage extending in an insertion direction between the ends, the passage having a rear open end communicating with the rear terminating end of the housing, and the front mating end of the housing having an open receptacle area;

a TPA device engageable with the housing at said front mating end thereof in a pre-load position whereat a substantial portion of the TPA device projects outside the housing beyond the front mating end thereof, the TPA device having a through passage coincident with the terminal-receiving passage in the housing and including a primary locking arm which is flexible outside the housing generally transversely of said insertion direction and having a primary lock portion exposed in the through passage; and a terminal insertable through the rear terminating end of the housing into the rear open end of the terminal-receiving passage and into the through passage in the TPA device, the terminal having a primary lock portion engageable by the primary lock portion of the primary locking arm of the TPA device, the TPA device and the terminal being movable conjointly rearwardly from said pre-load position to a locking position of the TPA device in the open receptacle area at the front mating end of the housing which defines an inserted mating position of the terminal, wherein said housing includes a secondary locking surface engageable with a secondary locking shoulder on the terminal.

14. The electrical connector of claim 13 wherein said primary lock portion on the terminal and said secondary locking shoulder on the terminal comprise portions of a single transverse locking shoulder on the terminal.

15. The electrical connector of claim 14 wherein said locking shoulder on the terminal extends transversely of the insertion direction of the terminal, said primary lock portion of the primary locking arm on the TPA device being engageable with the locking shoulder generally at the center thereof, and the housing has a pair of said secondary locking surfaces engageable with the locking shoulder at opposite sides of the primary locking arm.

* * * * *